US006282477B1

(12) United States Patent
Gudat et al.

(10) Patent No.: US 6,282,477 B1
(45) Date of Patent: Aug. 28, 2001

(54) METHOD AND APPARATUS FOR DISPLAYING AN OBJECT AT AN EARTHWORKING SITE

(75) Inventors: Adam J. Gudat, Edelstein; James J. Kalafut, Peoria; N. Keith Lay; Robert J. Price, both of Dunlap, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/592,960

(22) Filed: Jun. 13, 2000

Related U.S. Application Data

(60) Provisional application No. 60/188,055, filed on Mar. 9, 2000.

(51) Int. Cl.[7] ..... G02D 7/26

(52) U.S. Cl. ..... 701/50; 37/348

(58) Field of Search ..... 701/50, 213; 324/326; 37/348, 414; 172/3, 5, 233

(56) References Cited

U.S. PATENT DOCUMENTS

| | | | | |
|---|---|---|---|---|
| 5,193,883 | * | 3/1993 | Spies | 299/1.1 |
| 5,404,661 | | 4/1995 | Sahm et al. | 37/348 |
| 5,438,771 | | 8/1995 | Sahm et al. | 37/348 |
| 5,490,081 | * | 2/1996 | Kuromoto et al. | 364/474.2 |
| 5,631,658 | | 5/1997 | Gudat et al. | 342/457 |
| 5,836,398 | * | 11/1998 | White | 169/24 |
| 5,864,060 | | 1/1999 | Henderson et al. | 73/432.1 |
| 5,920,194 | * | 7/1999 | Lewis et al. | 324/326 |
| 5,991,694 | * | 11/1999 | Gudat et al. | 702/2 |
| 6,055,042 | * | 4/2000 | Sarangapani | 356/4.01 |
| 6,119,376 | * | 9/2000 | Stump | 37/348 |

* cited by examiner

*Primary Examiner*—Tan Nguyen
*Assistant Examiner*—Dalena Tran
(74) *Attorney, Agent, or Firm*—Steven D. Lundquist

(57) ABSTRACT

A method and apparatus for displaying a location of an object at an earthworking site. The method and apparatus includes determining a location in geographical coordinates of an earthworking implement at the earthworking site, determining a location in geographical coordinates of the object, displaying the earthworking implement and the object on a display having a top view and a side profile view of the earthworking site, selecting a perimeter of interest in the top view with respect to the earthworking implement, determining the coordinates of a portion of the object bounded by the perimeter of interest, and displaying a three-dimensional image of the portion of the object in the side profile view as a function of the perimeter of interest.

27 Claims, 7 Drawing Sheets

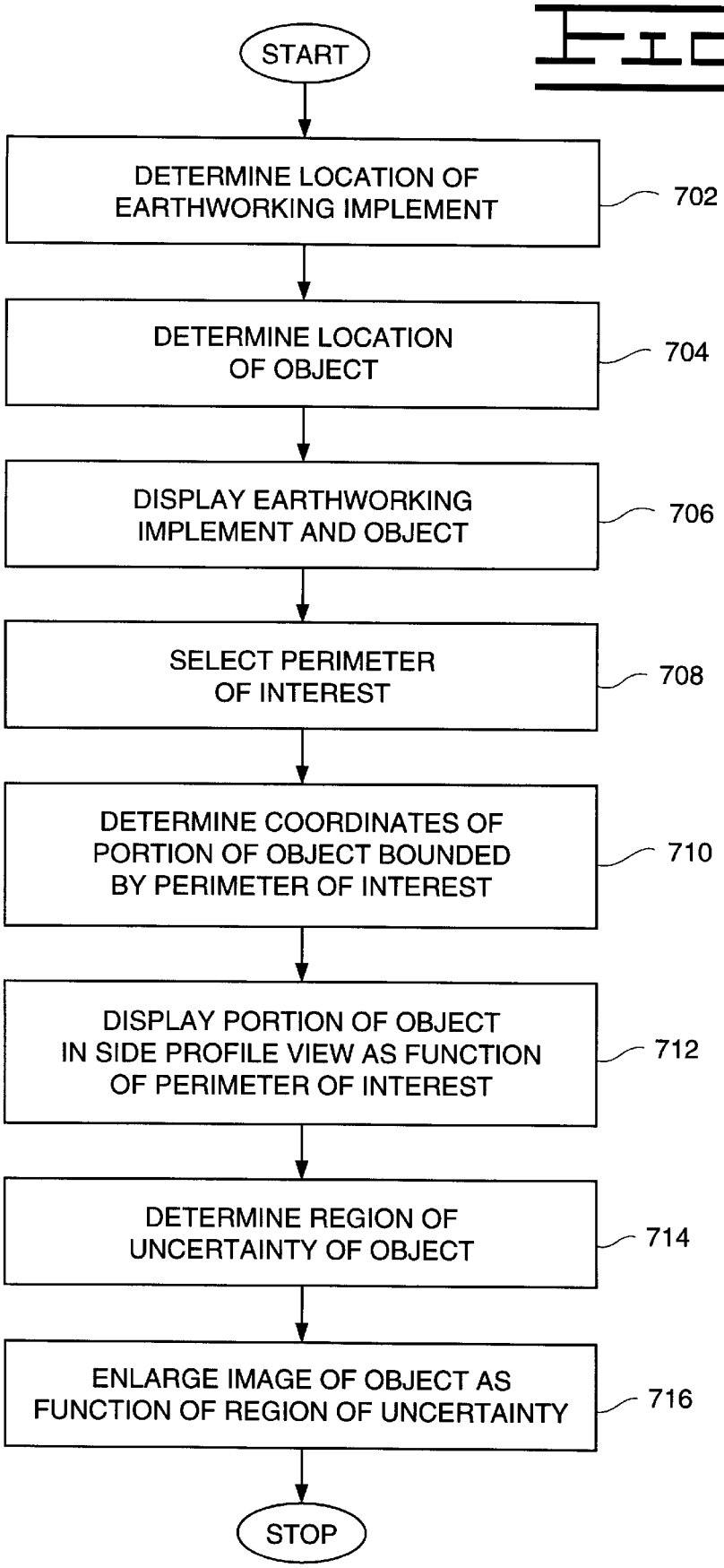
Fig. 7.
START
DETERMINE LOCATION OF EARTHWORKING IMPLEMENT
702
DETERMINE LOCATION OF OBJECT
704
DISPLAY EARTHWORKING IMPLEMENT AND OBJECT
706
SELECT PERIMETER OF INTEREST
708
DETERMINE COORDINATES OF PORTION OF OBJECT BOUNDED BY PERIMETER OF INTEREST
710
DISPLAY PORTION OF OBJECT IN SIDE PROFILE VIEW AS FUNCTION OF PERIMETER OF INTEREST
712
DETERMINE REGION OF UNCERTAINTY OF OBJECT
714
ENLARGE IMAGE OF OBJECT AS FUNCTION OF REGION OF UNCERTAINTY
716
STOP

METHOD AND APPARATUS FOR DISPLAYING AN OBJECT AT AN EARTHWORKING SITE

This application claims the benefit of prior provisional patent application Ser. No. 60/188,055 file Mar. 9, 2000.

TECHNICAL FIELD

This invention relates generally to a method and apparatus for displaying an object at a site of earthworking operations and, more particularly, to a method and apparatus for displaying the location of an underground object relative to an earthworking implement.

BACKGROUND ART

Earthworking machines, such as excavators, backhoes, front shovels, and the like, are used to perform a wide variety of tasks. For example, earthworking machines are used to dig foundations, install and maintain utilities, dig trenches, dredge waterways, perform landscaping operations, and accomplish many other jobs.

The extensive use of earthworking machines, and the associated expense of using them, has created a great need for technological improvements and innovations to make operations more efficient, more productive, less strenuous on human operators, and more accurate. For example, using terrain map data and position determining systems such as GPS, an operator of an earthworking machine may be provided with a display of the terrain being worked, the machine and earthworking implement as the work is performed, and changes being made to the terrain, all in real time. Examples of display technology being used by earthworking machines include U.S. Pat. No. 5,864,060 to Henderson et al., U.S. Pat. No. 5,438,771 to Sahm et al., U.S. Pat. No. 5,404,661 to Sahm et al., and U.S. Pat. No. 5,631,658 to Gudat et al.

However, a major problem associated with earthworking operations, and one that is not addressed by the above mentioned references, is the presence of already existing underground objects, such as utility lines, gas pipelines, and the like. Currently, an operator of an earthworking machine must rely on location marks, maps, and guesswork to avoid damaging underground objects. Often, as the operator of an earthworking machine approaches the estimated location of an underground object, the operator must stop and allow other workers to carefully hand dig further.

It is desired to be able to increase productivity and efficiency, yet minimize damage to underground objects without resorting to manual labor means, by providing the operator of an earthworking machine with an indication, preferably on a display, of the location of any known underground objects relative to the earthworking implement. It is also desired to provide an operator of an earthworking machine with a display of underground objects relative to the earthworking implement that compensates for errors introduced in determining the locations of the implement and the objects.

The present invention is directed to overcoming one or more of the problems as set forth above.

DISCLOSURE OF THE INVENTION

In one aspect of the present invention a method for displaying a location of an object at an earthworking site is disclosed. The method includes the steps of determining a location in geographical coordinates of an earthworking implement at the earthworking site, determining a location in geographical coordinates of the object, displaying the earthworking implement and the object on a display having a top view and a side profile view of the earthworking site, selecting a perimeter of interest in the top view with respect to the earthworking implement, determining the coordinates of a portion of the object bounded by the perimeter of interest, and displaying a three-dimensional image of the portion of the object in the side profile view as a function of the perimeter of interest.

In another aspect of the present invention a method for displaying a location of an object at an earthworking site is disclosed. The method includes the steps of determining a location in geographical coordinates of an earthworking implement at the earthworking site, determining a location in geographical coordinates of the object, displaying the earthworking implement and the object on a display having a top view and a side profile view of the earthworking site, determining a region of uncertainty of the object as a function of at least one parameter, and enlarging the side profile view of the image of the object as a function of the region of uncertainty.

In yet another aspect of the present invention a method for displaying a location of an object at an earthworking site is disclosed. The method includes the steps of determining a location in geographical coordinates of an earthworking implement at the earthworking site, determining a location in geographical coordinates of the object, displaying the earthworking implement and the object on a display having a top view and a side profile view of the earthworking site, selecting a perimeter of interest in the top view with respect to the earthworking implement, determining the coordinates of a portion of the object bounded by the perimeter of interest, displaying a three-dimensional image of the portion of the object in the side profile view as a function of the perimeter of interest, determining a region of uncertainty of the object as a function of at least one parameter, and enlarging the side profile view of the image of the object as a function of the region of uncertainty.

In yet another aspect of the present invention an apparatus for displaying a location of an object at an earthworking site is disclosed. The apparatus includes a position determining system adapted to determine a location of an earthworking implement at the earthworking site, means for determining a location of the object, a display having a top view and a side profile view of the earthworking site, means for selecting a perimeter of interest in the top view, and a processor adapted to determine a set of coordinates of a portion of the object within the perimeter of interest, display a three-dimensional image of the portion of the object in the side profile view, determine a region of uncertainty of the coordinates of the object, and enlarge the image of the object in the side profile view as a function of the region of uncertainty.

BRIEF DESCRIPTION OF THE DRAWINGS

FIG. 6 is a diagrammatic illustration of yet another embodiment of the present invention; and FIG. 7 is a flow diagram illustrating a preferred method of the present invention.

BEST MODE FOR CARRYING OUT THE INVENTION

Figure 1:
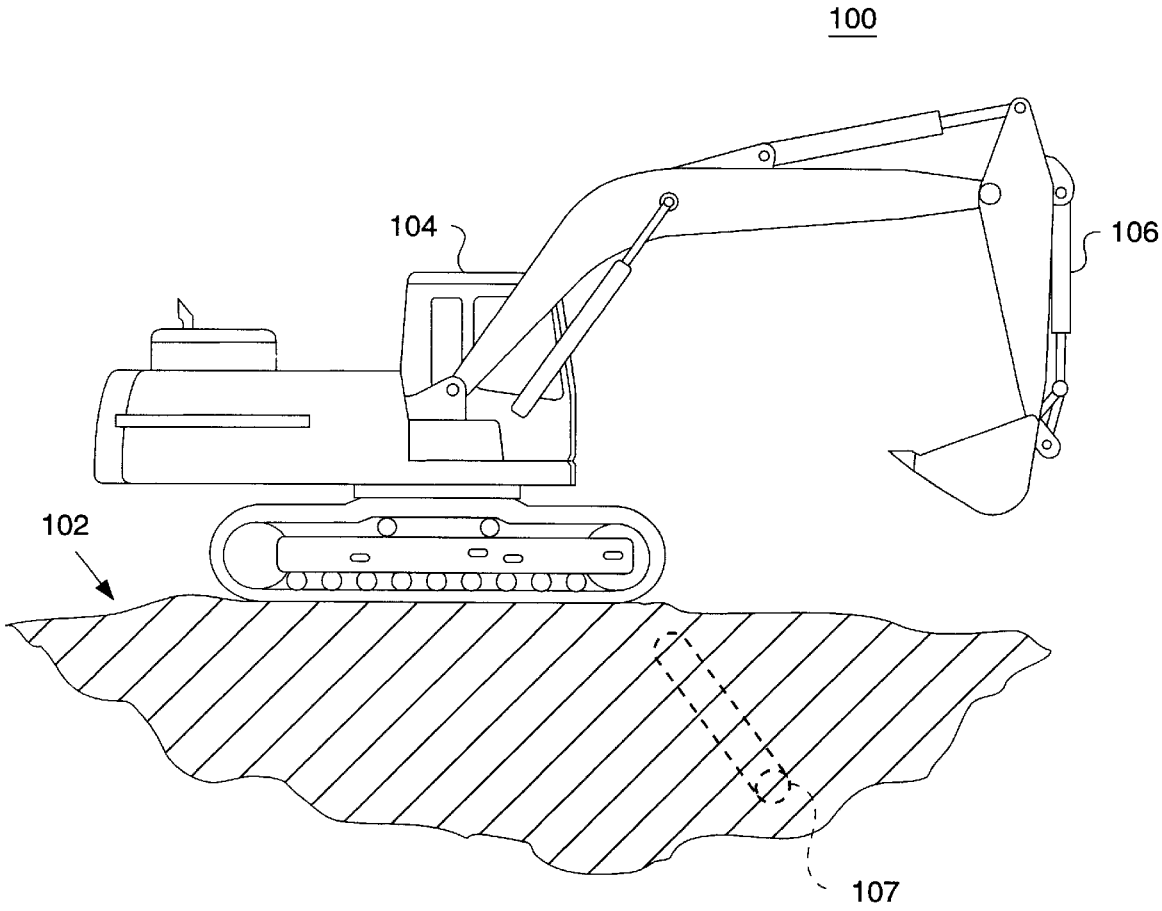
FIG. 1 is a diagrammatic illustration of an earthworking machine at an earthworking site.

Referring to the drawings, and with particular reference to FIG. 1, an apparatus 100 for displaying a location of an object at an earthworking site 102 is disclosed. The earthworking site 102 may be any location in which earthworking operations is being performed, such as digging, trenching, dredging, and the like.

An earthworking machine 104 is used to perform the earthworking operations. The earthworking machine 104 in FIG. 1 is depicted as an excavator. However, other types of earthworking machines, e.g., backhoe loaders, front shovels, trenchers, boring machines, and the like, may be used as well.

Preferably, the earthworking machine 104 includes an earthworking tool 106, such as a bucket, blade, drill, and such, controllably attached to the earthworking machine 104.

An object 107, located under the surface of the earthworking site 102, needs to be protected from damage by the earthworking operations. The object 107 may be a utility line, pipe, or some other item that is known to exist, but must be approached during earthworking operations without disturbing it. As described in more detail below, the location of the object 107 may be known with good accuracy, or may be estimated, thus requiring varying degrees of care as the object 107 is approached by the earthworking implement 106.

Figure 2:
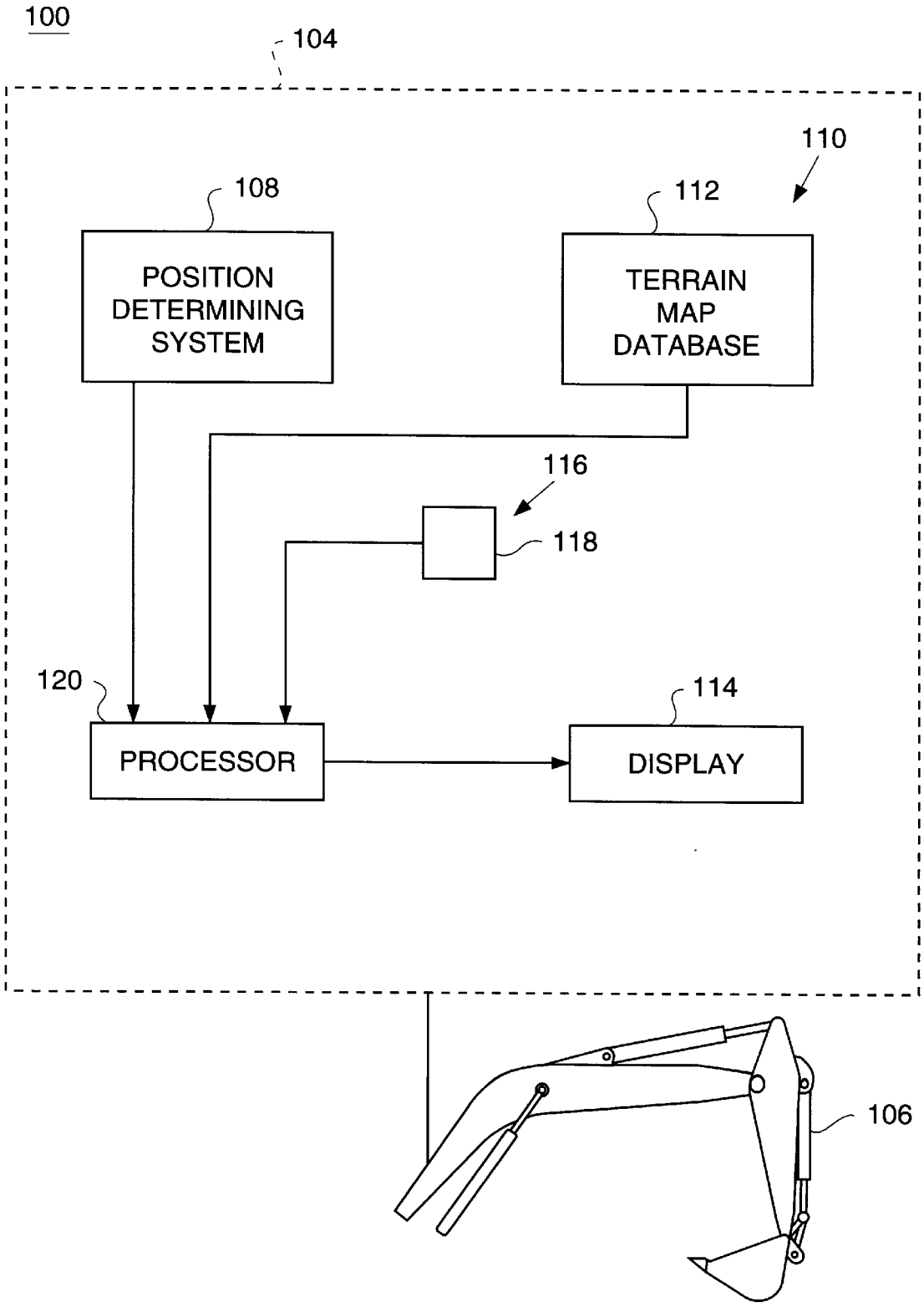
FIG. 2 is a block diagram illustrating a preferred embodiment of the present invention.

Referring to FIG. 2, a preferred embodiment of the apparatus 100 of the present invention is shown.

A position determining system 108, located on the earthworking machine 104, is adapted to determine a location of the earthworking implement 106 at the earthworking site 102. In the preferred embodiment, the position determining system 108 is a global position satellite (GPS) system, having an antenna (not shown) mounted on the earthworking machine 104. The position of the earthworking implement 106 may then be determined in geographical coordinates. Preferably, and as is well known in the art, the earthworking implement 106, having a set of linkages, includes a set of angular position sensors (not shown), such as resolvers. The position of the earthworking implement 106 may then be determined by determining the positions of the GPS antenna in coordination with the positions of the resolvers. For example, an excavator has a boom, stick, and a bucket, and a cab mounted on the excavator frame. The GPS antenna may be mounted on top of the cab, and the linkages connecting the boom, stick, and bucket may each have an angular position sensor. The position determinations of the GPS antenna and each of the angular resolvers may then be determined to find the position of the bucket in geographical coordinates.

Alternatively, the position determining system 108, e.g., the GPS antenna, may be mounted directly on the earthworking implement 106 in a manner which protects the position determining system 108 from damage, allowing a direct determination of the position of the earthworking implement 106.

In an alternate embodiment, the position determining system 108 may be of another type, such as a laser plane positioning system, dead reckoning, or some combination of technologies thereof.

A means 110 for determining a location of the object 107 is located on the earthworking machine 104. In the preferred embodiment, the means 110 for determining the location of the object 107 is a terrain map database 112, adapted to store a map of the locations of the objects 107 in geographical coordinates. It is known in the art that subsurface maps of underground objects may be made available for downloading into terrain map databases. For example, utility companies may provide maps in a data format of the locations of their buried utilities. These maps are readily available for use by earthworking operators to inform them of the locations of the utilities to assist in avoidance of disturbing the utilities during earthworking operations. Preferably, the maps are available in a format that is compatible with the terrain map database 112.

Alternatively, the locations of underground objects 107 may be determined with the use of underground locating equipment, such as acoustic, electromagnetic, or radar locators, prior to digging. The data obtained from the locating process may then be input to the terrain map database.

Figure 3:
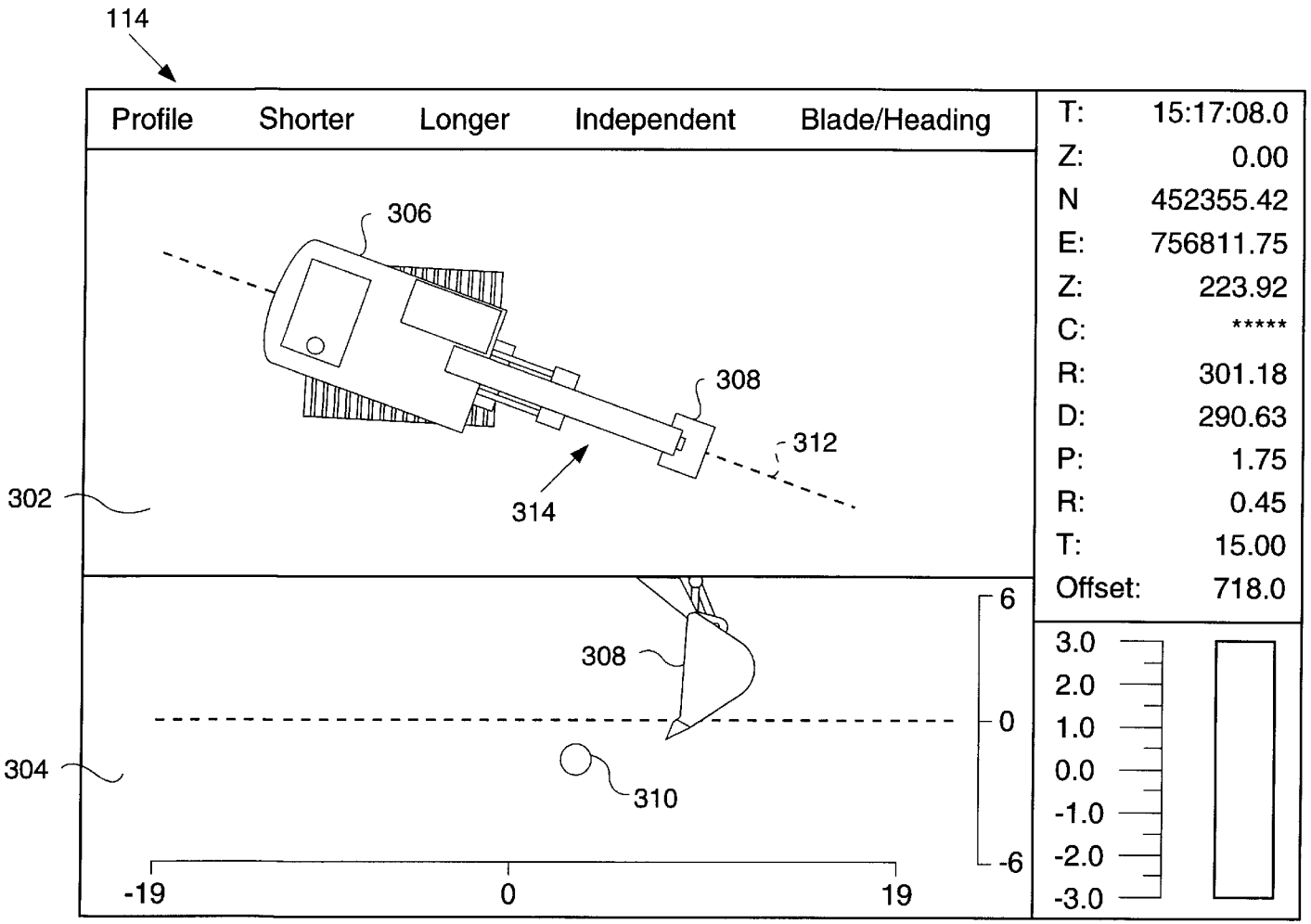
FIG. 3 is a diagrammatic illustration of a display depicting one aspect of the present invention.
Figure 4:
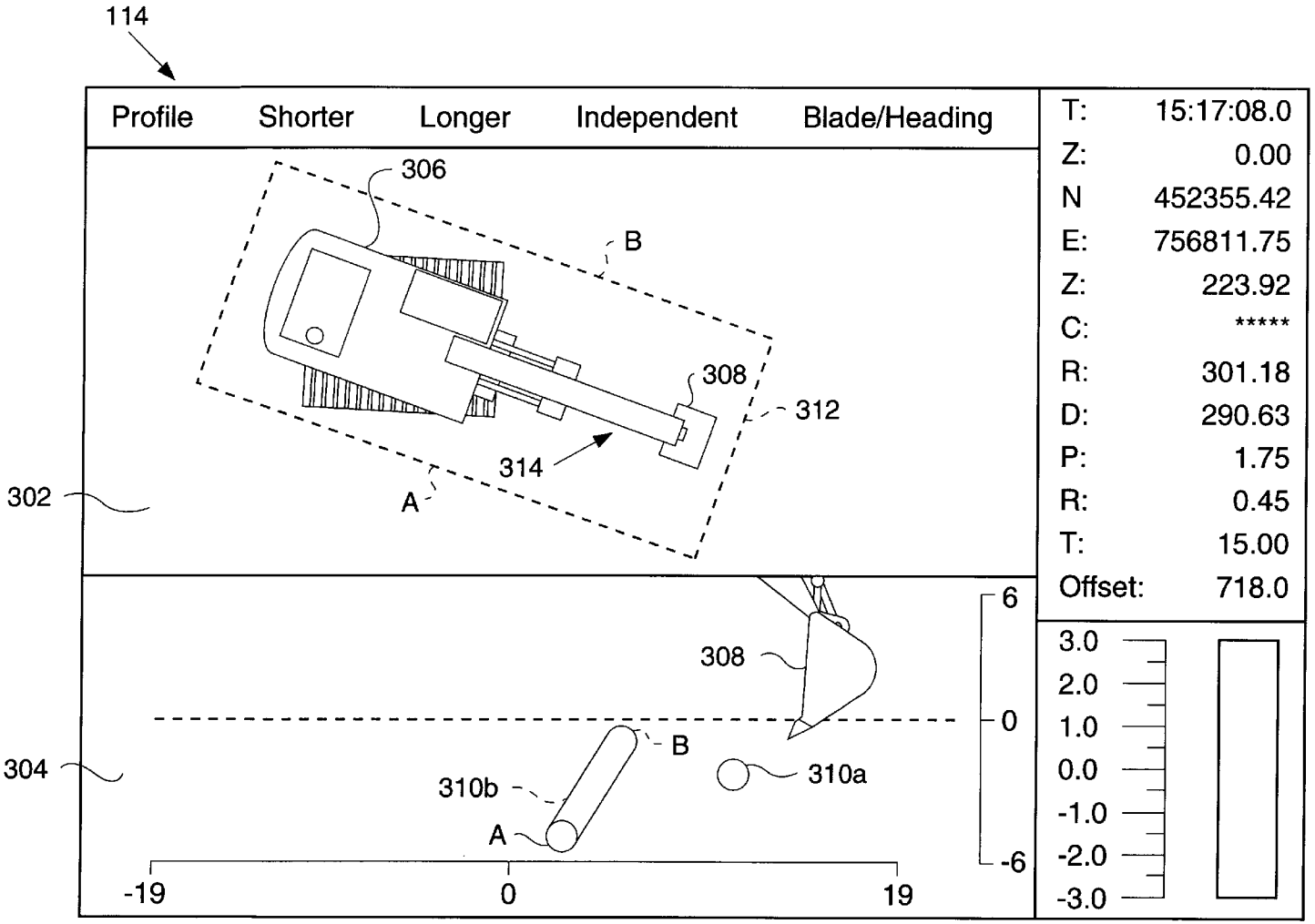
FIG. 4 is a diagrammatic illustration of a display depicting another aspect of the present invention.

A display 114, located on the earthworking machine 104, is adapted to provide a view of earthworking operations, preferably in real time. FIGS. 3 and 4 provide exemplary illustrations of how a display 114 might appear. For example, the display 114 depicted in FIGS. 3 and 4 include a top view 302 and a side profile view 304 of the earthworking site 102. An image 306 of the earthworking machine 104 displays the location of the earthworking machine 104 with respect to the earthworking site 102. An image 308 of the earthworking implement 106 displays the location of the earthworking implement 106 with respect to the earthworking site 102. As shown in FIGS. 3 and 4, the image 306 of the earthworking machine 104 is shown in the top view 302, and the image 308 of the earthworking implement 106 is shown in both the top and side profile views 302,304.

In FIG. 3, an image 310 of the object 107 is shown in the side profile view 304. In FIG. 4, images 310*a*,310*b* of two objects 107 are shown in the side profile view 304. The images 310 of the objects 107 are described in more detail below.

A means 116 for selecting a perimeter of interest 312 is located on the earthworking machine 104. In the preferred embodiment, and as illustrated in FIGS. 3 and 4, the perimeter of interest 312 is shown in the top view 302 of the display 114. Preferably, the means 116 for selecting a perimeter of interest 312 is a set of operator selectable controls 118. For example, the operator selectable controls 118 may be located on or near the display 114 to allow an operator of the earthworking machine 104 the ability to select a desired size of the perimeter of interest 312.

As a first example, in FIG. 3, the perimeter of interest 312 has been selected to be a line located at about a longitudinal axis of the earthworking machine 104. Consequently, in the side profile view 304, the image 310 of the object 107 represents a cross-section slice of the object 107 at the perimeter of interest 312, i.e., the line. Therefore, the image 310 of the object 107 is represented in two-dimensional view.

As a second example, in FIG. 4, the perimeter of interest 312 has been selected to be a rectangle having a first side A and a second side B. Consequently, in the side profile view 304, the images 310*a*,310*b* of two objects 107 represent cross-sections of the objects 107 from the first side A of the perimeter 312 to the second side B of the perimeter 312. Therefore, the images 310*a*,310*b* of the two objects 107 are represented in three-dimensional view. The image 310*a* of the first object 107 is perpendicular to the perimeter of interest 312, and does not change depth from line A to line B. Therefore, the image 310*a* of the first object 107 appears as though it was a two-dimensional image. The image 310*b* of the second object 107 is not perpendicular to the perimeter of interest 312 and changes in depth from line A to line B. Therefore, the angle of the image 310*b* relative to the perimeter of interest 312 and the change in depth of the image 310*b* is shown as a third dimension in the side profile view 304. From this three-dimensional view of the object 107, the operator is made aware that the object 107 is not buried at a level depth, but is sloped in the ground, and that the object will not be approached by the earthworking implement 106 at a perpendicular angle. Therefore, the operator is better able to avoid disturbing the object 107 as he digs.

In the preferred embodiment, the perimeter of interest 312 is selected about a center portion 314 in which the earthworking implement 106 performs earthworking operations.

A processor 120, located on the earthworking machine 104, is adapted to determine a set of coordinates of a portion of the object 107 within the perimeter of interest, i.e., from line A to line B. The processor 120 is also adapted to display a three-dimensional image of the portion of the object 107 in the side profile view 304 of the display 114.

Figure 5:
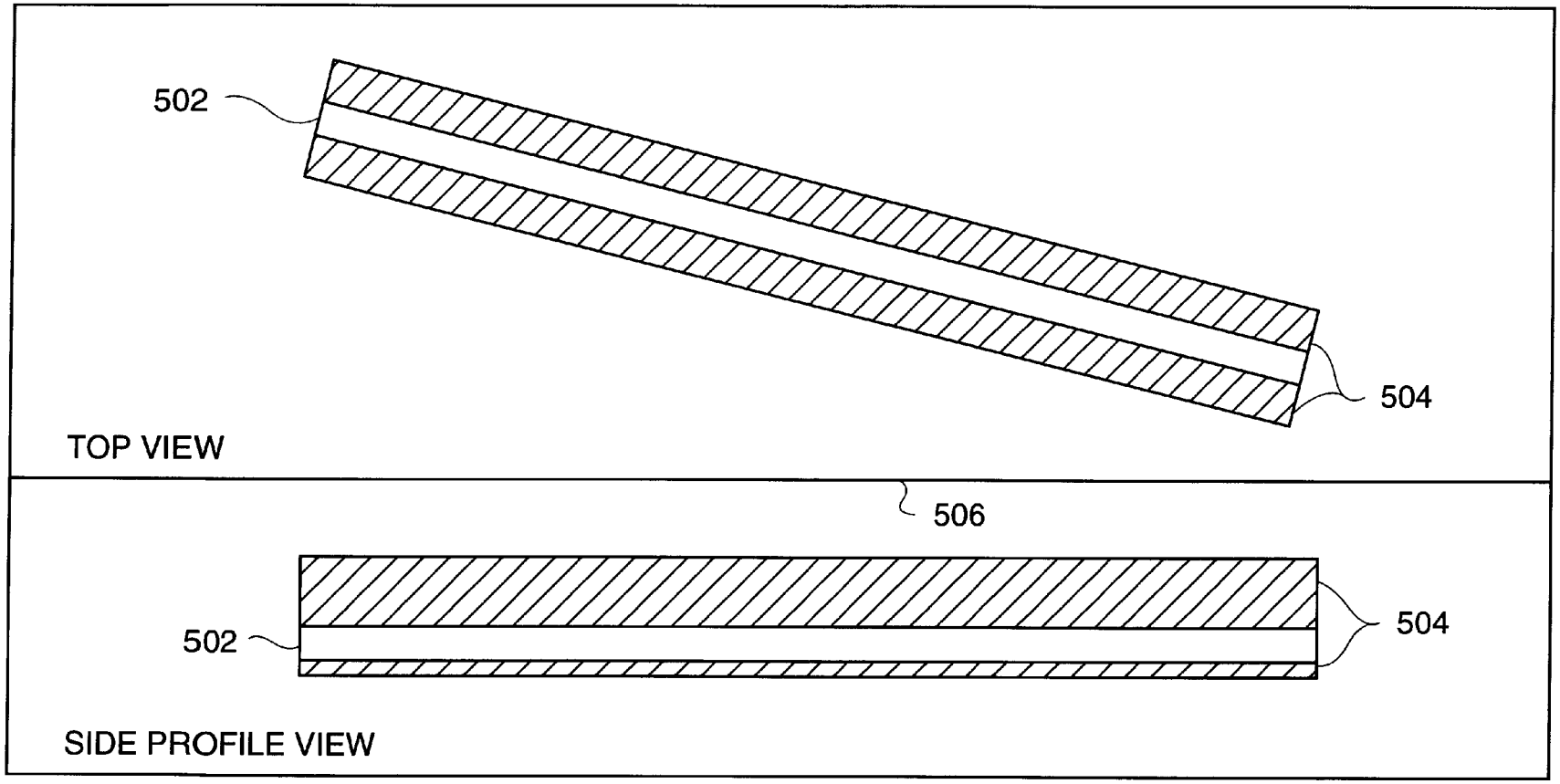
FIG. 5 is a diagrammatic illustration of another embodiment of the present invention.
Figure 5:
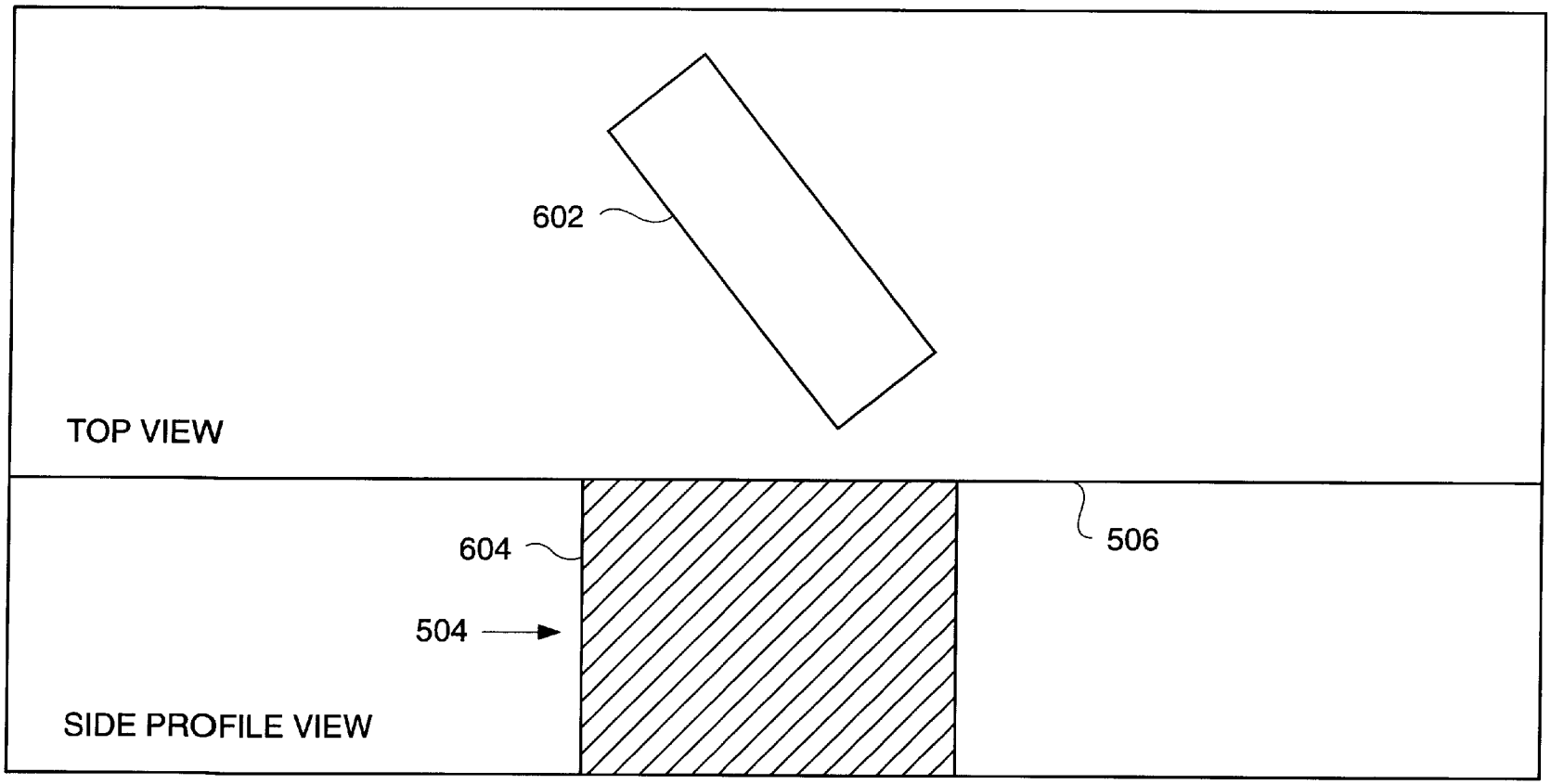

The above discussion is made with reference to a first aspect of the present invention. Referring to FIG. 5, a second aspect of the present invention is illustrated.

In the top view of FIG. 5, a determined location 502 of an object is shown. The determined location 502 is also shown in the side profile view of FIG. 5, located beneath the surface 506 of the earth. Therefore, as shown in FIG. 5 the determined location 502 of the object is known in three dimensions.

A region of uncertainty 504 is shown surrounding the determined location 502 of the object. The region of uncertainty 504 is a function of at least one parameter, including, but not limited to, inherent errors in the position determining system 108, errors in the determined location 502 of the object, and the level of importance of maintaining the object in an undisturbed state during earthworking operations, the level of importance being expressed as a priority factor. For example, a gas pipeline may require a higher priority factor than a cable television line, thus requiring a larger region of uncertainty 504.

In the preferred embodiment, the region of uncertainty 504 is reflected in the display 114 by enlarging the size of the image 310 of the object 107. This provides an additional buffer in protecting the object 107 from disturbance by the earthworking implement 106 as earthworking operations take place. It is noted in FIG. 5 that the region of uncertainty 504 in the side profile view is shown larger above the determined location 502 of the object than below. During normal earthworking operations, the earthworking implement 106 would approach the object 107 from above. Therefore, by increasing the region of uncertainty 504 above the determined location 502 of the object as compared to below the determined location 502, an additional buffer is provided where needed the most.

Referring to FIG. 6, a third aspect of the present invention is illustrated. In the top view of FIG. 6, an estimated location 602 of the object is shown. In some situations, it is known that an object 107 exists below the surface 506 of the earth, but the location of the object cannot be determined with any degree of accuracy. Therefore, the location of the object 107 must be estimated. In the side profile view of FIG. 6, the region of uncertainty 504 is determined as a wall of uncertainty 604. The wall of uncertainty 604 reflects the condition that the location of the object 107 is only an estimated location 602. The depth of the object 107 in the earth cannot even be estimated for useful purposes. Therefore, the wall of uncertainty encompasses an estimated perimeter at the surface 506 of the earth and then extends down into the earth as far as necessary to avoid disturbing the object 107. In this aspect, the earthworking implement 106 may be used to dig to the wall of uncertainty 604, but other conventional means, e.g., hand digging, must be employed within the wall of uncertainty 604.

In the preferred embodiment, the processor 120 is adapted to determine either the region of uncertainty 504 or the wall of uncertainty 604, as needed, of the coordinates of the object 107, and responsively enlarge the image 310 of the object 107 in the side profile view 304 of the display 114.

Referring to FIG. 7, a flow diagram illustrating a preferred method of the present invention is shown.

In a first control block 702, the location of the earthworking implement 106 is determined, preferably in geographical coordinates, using a coordinate system such as a Cartesian coordinate system having x, y, and z coordinates. In the preferred embodiment, the location of the earthworking implement 106 is determined as described above.

In a second control block 704, the location of the object 107 is determined in geographical coordinates, as described above.

In a third control block 706, images 306,308,310 of the earthworking machine 104, earthworking implement 106, and object 107, respectively, are shown on a display, in real time, relative to the earthworking site 102. Preferably, as illustrated in FIGS. 3 and 4, the images 306,308 of the earthworking machine 104 and the earthworking implement 106 are displayed in a top view 302, and the images 308,310 of the earthworking implement 106 and the object 107 are displayed in a side profile view 304.

In a fourth control block 708, the perimeter of interest 312 is selected by the operator of the earthworking machine 104. In the preferred embodiment, the perimeter of interest 312 is selected to allow a desired three-dimensional view of the image 310 of the object 107 in the side profile view 304. The three-dimensional view of the image 310 of the object 107 provides the operator with a conception of the location of the object at both sides of the earthworking implement 106, which allows the operator to be more efficient and productive without disturbing the object 107 as the earthworking operations take place.

In a fifth control block 710, the coordinates of the portion of the object 107 bounded by the perimeter of interest 312 are determined, preferably by the processor 120. The illustrated display of FIG. 4 indicates that the object 107 is bounded by the perimeter of interest 312 by a first line A and a second line B.

In a sixth control block 712, the portion of the object 107 bounded by the perimeter of interest 312 is displayed in the side profile view 304 of the display 114. The image 310 of the object 107 is displayed in three dimensions to indicate any variations in the depth of the object 107 from line A to line B relative to the surface of the earthworking site 102.

In a seventh control block 712, a region of uncertainty 504 of the object 107 is determined as a function of at least one parameter. Examples of parameters include, but are not limited to, a range of error allowable by the position determining system 108, a range of error of the determined location of the object 107, and a priority factor of the object 107, the priority factor being a function of the importance of not disturbing the object 107 during earthworking operations.

In an eighth control block 716, the image 310 of the object 107 in the side profile view 304 of the display 114 is enlarged as a function of the region of uncertainty 504. Preferably, the image 310 of the object 107 is enlarged as compared to the remainder of the display 114. The enlarged image 310 of the object 107 provides a buffer zone to further reduce the chance of disturbing the object 107 during earthworking operations.

In one aspect of the present invention, the region of uncertainty 504 is determined with respect to the known position of the object 107. In another aspect of the present invention, the region of uncertainty 504 is a wall of uncertainty 604, and is determined with respect to an estimated position of the object 107.

INDUSTRIAL APPLICABILITY

As an example of an application of the present invention, an earthworking machine 104, e.g., an excavator, performs earthworking operations such as digging the earth. Frequently, the earthworking machine 104 is required to dig in areas in which underground objects 107, e.g., utility lines and pipes, are known to be buried. A display 114, in particular a side profile view 304 of a display 114, is known in the art to provide a good indication to an operator of the earthworking machine 104 of the location of the earthworking implement 106 relative to the earthworking site. The objects 107 may also be shown on the display 114 to give the operator a view of the location of the object 107 relative to the earthworking implement 106. However, it is difficult, if not impossible, to know the location of buried objects 107 with a high degree of accuracy. The present invention, therefore, compensates for the position inaccuracies by displaying an image 310 of the object 107 in a three-dimensional view to account for varying depths of the object 107, and for varying angles of the object 107 relative to the earthworking implement 106. In another aspect of the present invention, the image 310 of the object 107 is enlarged by a region of uncertainty 504 to compensate for errors in position determination.

Other aspects, objects, and features of the present invention can be obtained from a study of the drawings, the disclosure, and the appended claims.

What is claimed is:

1. A computer-based method for displaying a location of an object at an earthworking site, including the steps of:

determining a location in geographical coordinates of an earthworking implement at the earthworking site;

determining a location in geographical coordinates of the object;

displaying the earthworking implement and the object on a display having a top view and a side profile view of the earthworking site;

selecting a perimeter of interest in the top view with respect to the earthworking implement;

determining the coordinates of a portion of the object bounded by the perimeter of interest; and displaying a three-dimensional image of the portion of the object in the side profile view as a function of the perimeter of interest.

2. A computer-based method, as set forth in claim 1, further including the steps of:

determining a region of uncertainty of the object as a function of at least one parameter; and enlarging the side profile view of the image of the object as a function of the region of uncertainty.

3. A computer-based method, as set forth in claim 1, further including the steps of:

determining a location of an earthworking machine, the earthworking implement being controllably attached to the earthworking machine; and displaying the location of the earthworking machine on the display.

4. A computer-based method, as set forth in claim 2, wherein the object is located under the surface of the earth.

5. A computer-based method, as set forth in claim 4, wherein determining a location in geographical coordinates of the object includes the step of determining the location of the object in three coordinates of a three-coordinate system.

6. A computer-based method, as set forth in claim 5, wherein enlarging the side profile view of the image of the object includes the step of enlarging the dimensions of the object with respect to the rest of the display dimensions.

7. A computer-based method, as set forth in claim 4, wherein determining a location in geographical coordinates of the object includes the step of determining an estimated location of the object with respect to the surface of the earth.

8. A computer-based method, as set forth in claim 7, wherein determining a region of uncertainty includes the step of determining a wall of uncertainty extending in a downward direction from the surface of the earth at the estimated location of the object.

9. A computer-based method, as set forth in claim 2, wherein the at least one parameter includes a margin of error of the step of determining a location of the earthworking implement.

10. A computer-based method, as set forth in claim 2, wherein the at least one parameter includes a margin of error of the step of determining a location of the object.

11. A computer-based method, as set forth in claim 2, wherein the at least one parameter includes a priority factor of the object, the priority factor being a function of a level of importance of maintaining the object in an undisturbed state during earthworking operations.

12. A computer-based method, as set forth in claim 1, wherein selecting a perimeter of interest includes the step of selecting a desired area of the earthworking site, the desired area having a center portion in which the earthworking implement performs earthworking operations.

13. A computer-based method for displaying a location of an object at an earthworking site, including the steps of:

determining a location in geographical coordinates of an earthworking implement at the earthworking site;

determining a location in geographical coordinates of the object;

displaying the earthworking implement and the object on a display having a top view and a side profile view of the earthworking site;

determining a region of uncertainty of the object as a function of at least one parameter; and enlarging the side profile view of the image of the object as a function of the region of uncertainty.

14. A computer-based method, as set forth in claim 13, further including the steps of:

selecting a perimeter of interest in the top view with respect to the earthworking implement;

determining the coordinates of a portion of the object bounded by the perimeter of interest; and displaying a three-dimensional image of the portion of the object in the side profile view as a function of the perimeter of interest.

15. A computer-based method, as set forth in claim 14, wherein the object is located underground.

16. A computer-based method, as set forth in claim 15, wherein the geographical coordinates are determined in a Cartesian coordinate system, and wherein determining a location of the object includes the step of determining the location of the object in three-dimensional Cartesian coordinates.

17. A computer-based method, as set forth in claim 16, wherein enlarging the side profile view of the image of the object includes the step of enlarging the dimensions of the object without enlarging the dimensions of the rest of the display.

18. A computer-based method, as set forth in claim 15, wherein determining a location of the object includes the step of estimating a location of the object with respect to the surface of the earth.

19. A computer-based method, as set forth in claim 18, wherein determining a region of uncertainty includes the step of determining a wall of uncertainty, the wall of uncertainty being determined by estimating an area on the surface of the earth and extending the estimated area in a downward direction into the earth.

20. A computer-based method, as set forth in claim 14, wherein the at least one parameter includes at least one of:

a margin of error of the step of determining a location of the earthworking implement;

a margin of error of the step of determining a location of the object; and a priority factor of the object, the priority factor being a function of a level of importance of maintaining the object in an undisturbed state during earthworking operations.

21. A computer-based method for displaying a location of an object at an earthworking site, including the steps of:

determining a location in geographical coordinates of an earthworking implement at the earthworking site;

determining a location in geographical coordinates of the object;

displaying the earthworking implement and the object on a display having a top view and a side profile view of the earthworking site;

selecting a perimeter of interest in the top view with respect to the earthworking implement;

determining the coordinates of a portion of the object bounded by the perimeter of interest;

displaying a three-dimensional image of the portion of the object in the side profile view as a function of the perimeter of interest;

determining a region of uncertainty of the object as a function of at least one parameter; and enlarging the side profile view of the image of the object as a function of the region of uncertainty.

22. An apparatus for displaying a location of an object at an earthworking site, comprising:

a position determining system adapted to determine a location of an earthworking implement at the earthworking site;

means for determining a location of the object;

a display having a top view and a side profile view of the earthworking site;

means for selecting a perimeter of interest in the top view; and a processor adapted to determine a set of coordinates of a portion of the object within the perimeter of interest, display a three-dimensional image of the portion of the object in the side profile view, determine a region of uncertainty of the coordinates of the object, and enlarge the image of the object in the side profile view as a function of the region of uncertainty.

23. An apparatus, as set forth in claim 22, wherein the means for determining the location of an object includes a terrain map database.

24. An apparatus, as set forth in claim 22, wherein the display is adapted to display the location of the earthworking implement and the object with respect to the earthworking site.

25. An apparatus, as set forth in claim 22, wherein the perimeter of interest is a function of a desired area of the earthworking site, the desired area having a center portion in which the earthworking implement performs earthworking operations.

26. An apparatus, as set forth in claim 25, wherein the means for selecting a perimeter of interest includes operator selectable controls.

27. An apparatus, as set forth in claim 22, further including an earthworking machine, the earthworking implement being controllably attached to the earthworking machine, and wherein the position determining system, the means for determining a location of the object, the display, the means for selecting a perimeter of interest, and the processor are located on the earthworking machine.

* * * * *